US010118217B2

(12) United States Patent
Hardwicke et al.

(10) Patent No.: US 10,118,217 B2
(45) Date of Patent: Nov. 6, 2018

(54) METHOD AND ASSEMBLY FOR FORMING COMPONENTS HAVING INTERNAL PASSAGES USING A JACKETED CORE

(71) Applicant: General Electric Company, Schenectady, NY (US)

(72) Inventors: Canan Uslu Hardwicke, Simpsonville, SC (US); Stanley Frank Simpson, Simpsonville, SC (US); Joseph Leonard Moroso, Greenville, SC (US)

(73) Assignee: General Electric Company, Schenectady, NY (US)

( * ) Notice: Subject to any disclaimer, the term of this patent is extended or adjusted under 35 U.S.C. 154(b) by 271 days.

(21) Appl. No.: 14/973,250

(22) Filed: Dec. 17, 2015

(65) Prior Publication Data

US 2017/0173666 A1 Jun. 22, 2017

(51) Int. Cl.

| | |
|---|---|
| ***B22C 3/00*** | (2006.01) |
| ***B22C 9/10*** | (2006.01) |
| ***B22C 9/24*** | (2006.01) |
| ***B22D 19/00*** | (2006.01) |

(52) U.S. Cl.

CPC ..... *B22C 3/00* (2013.01); *B22C 9/10* (2013.01); *B22C 9/101* (2013.01); *B22C 9/103* (2013.01); *B22C 9/24* (2013.01); *B22D 19/0072* (2013.01)

(58) Field of Classification Search

CPC .... B22C 1/00; B22C 3/00; B22C 9/02; B22C 9/10; B22C 9/103; B22C 9/108; B22C 9/12; B22C 9/24; B22D 19/0072

USPC ..... 164/14, 33, 91, 365, 366, 367, 369

See application file for complete search history.

(56) References Cited

U.S. PATENT DOCUMENTS

| | | | |
|---|---|---|---|
| 2,687,278 | A | 8/1954 | Smith et al. |
| 2,756,475 | A | 7/1956 | Hanink et al. |
| 2,991,520 | A | 7/1961 | Dalton |
| 3,160,931 | A | 12/1964 | Leach |
| 3,222,435 | A | 12/1965 | Mellen, Jr. et al. |
| 3,222,737 | A | 12/1965 | Reuter |
| 3,475,375 | A | 10/1969 | Yates |
| 3,563,711 | A | 2/1971 | Hammond et al. |

(Continued)

FOREIGN PATENT DOCUMENTS

| | | | |
|---|---|---|---|
| CH | 640440 | A5 | 1/1984 |
| EP | 0025481 | A1 | 3/1981 |

(Continued)

OTHER PUBLICATIONS

European Search Report and Opinion issued in connection with related EP Application No. 16202422.8 dated May 8, 2017.

(Continued)

*Primary Examiner* — Kevin P Kerns

(74) *Attorney, Agent, or Firm* — Armstrong Teasdale LLP

(57) ABSTRACT

A mold assembly for use in forming a component having an internal passage defined therein includes a mold defining a mold cavity therein, and a jacketed core positioned with respect to the mold. The jacketed core includes a hollow structure, and an inner core disposed within the hollow structure and positioned to define the internal passage within the component when a component material in a molten state is introduced into the mold cavity and cooled to form the component. The jacketed core also includes a first coating layer disposed between the hollow structure and the inner core.

11 Claims, 8 Drawing Sheets

(56) References Cited

U.S. PATENT DOCUMENTS 3,596,703 A 8/1971 Bishop et al.
3,597,248 A 8/1971 Yates
3,662,816 A 5/1972 Bishop et al.
3,678,987 A 7/1972 Kydd
3,689,986 A 9/1972 Takahashi et al.
3,694,264 A 9/1972 Weinland et al.
3,773,506 A 11/1973 Larker et al.
3,824,113 A 7/1974 Loxley et al.
3,844,727 A 10/1974 Copley et al.
3,863,701 A 2/1975 Niimi et al.
3,866,448 A 2/1975 Dennis et al.
3,921,271 A 11/1975 Dennis et al.
3,996,048 A 12/1976 Fiedler
4,096,296 A 6/1978 Galmiche et al.
4,130,157 A 12/1978 Miller et al.
4,148,352 A 4/1979 Sensui et al.
4,236,568 A 12/1980 Larson
4,285,634 A 8/1981 Rossman et al.
4,352,390 A 10/1982 Larson
4,372,404 A 2/1983 Drake
4,375,233 A 3/1983 Rossmann et al.
4,417,381 A 11/1983 Higginbotham
4,432,798 A 2/1984 Helferich et al.
4,557,691 A 12/1985 Martin et al.
4,576,219 A 3/1986 Uram
4,583,581 A 4/1986 Ferguson et al.
4,604,780 A 8/1986 Metcalfe
4,637,449 A 1/1987 Mills et al.
4,738,587 A 4/1988 Kildea
4,859,141 A 8/1989 Maisch et al.
4,905,750 A 3/1990 Wolf
4,911,990 A 3/1990 Prewo et al.
4,964,148 A 10/1990 Klostermann et al.
4,986,333 A 1/1991 Gartland
5,052,463 A 10/1991 Lechner et al.
5,083,371 A 1/1992 Leibfried et al.
5,243,759 A 9/1993 Brown et al.
5,248,869 A 9/1993 Debell et al.
5,273,104 A 12/1993 Renaud et al.
5,291,654 A 3/1994 Judd et al.
5,295,530 A 3/1994 O'Connor et al.
5,332,023 A 7/1994 Mills
5,350,002 A 9/1994 Orton
5,355,668 A 10/1994 Weil et al.
5,371,945 A 12/1994 Schnoor
5,387,280 A 2/1995 Kennerknecht
5,394,932 A 3/1995 Carozza et al.
5,398,746 A 3/1995 Igarashi
5,413,463 A 5/1995 Chin et al.
5,465,780 A 11/1995 Muntner et al.
5,467,528 A 11/1995 Bales et al.
5,468,285 A 11/1995 Kennerknecht
5,482,054 A 1/1996 Slater et al.
5,498,132 A 3/1996 Carozza et al.
5,505,250 A 4/1996 Jago
5,507,336 A 4/1996 Tobin
5,509,659 A 4/1996 Igarashi
5,524,695 A 6/1996 Schwartz
5,569,320 A 10/1996 Sasaki et al.
5,611,848 A 3/1997 Sasaki et al.
5,664,628 A 9/1997 Koehler et al.
5,679,270 A 10/1997 Thornton et al.
5,738,493 A 4/1998 Lee et al.
5,778,963 A 7/1998 Parille et al.
5,810,552 A 9/1998 Frasier
5,820,774 A 10/1998 Dietrich
5,909,773 A 6/1999 Koehler et al.
5,924,483 A 7/1999 Frasier
5,927,373 A 7/1999 Tobin
5,947,181 A 9/1999 Davis
5,951,256 A 9/1999 Dietrich
5,976,457 A 11/1999 Amaya et al.
6,029,736 A 2/2000 Naik et al.
6,039,763 A 3/2000 Shelokov
6,041,679 A 3/2000 Slater et al.
6,068,806 A 5/2000 Dietrich
6,186,741 B1 2/2001 Webb et al.
6,221,289 B1 4/2001 Corbett et al.
6,234,753 B1 5/2001 Lee
6,244,327 B1 6/2001 Frasier
6,251,526 B1 6/2001 Staub
6,327,943 B1 12/2001 Wrigley et al.
6,359,254 B1 3/2002 Brown
6,441,341 B1 8/2002 Steibel et al.
6,467,534 B1 10/2002 Klug et al.
6,474,348 B1 11/2002 Beggs et al.
6,505,678 B2 1/2003 Mertins
6,557,621 B1 5/2003 Dierksmeier et al.
6,578,623 B2 6/2003 Keller et al.
6,605,293 B1 8/2003 Giordano et al.
6,615,470 B2 9/2003 Corderman et al.
6,623,521 B2 9/2003 Steinke et al.
6,626,230 B1 9/2003 Woodrum et al.
6,634,858 B2 10/2003 Roeloffs et al.
6,637,500 B2 10/2003 Shah et al.
6,644,921 B2 11/2003 Bunker et al.
6,670,026 B2 12/2003 Steibel et al.
6,694,731 B2 2/2004 Kamen et al.
6,773,231 B2 8/2004 Bunker et al.
6,799,627 B2 10/2004 Ray et al.
6,800,234 B2 10/2004 Ferguson et al.
6,817,379 B2 11/2004 Perla
6,837,417 B2 1/2005 Srinivasan
6,896,036 B2 5/2005 Schneiders et al.
6,913,064 B2 7/2005 Beals et al.
6,929,054 B2 8/2005 Beals et al.
6,955,522 B2 10/2005 Cunha et al.
6,986,381 B2 1/2006 Ray et al.
7,028,747 B2 4/2006 Widrig et al.
7,036,556 B2 5/2006 Caputo et al.
7,052,710 B2 5/2006 Giordano et al.
7,073,561 B1 7/2006 Henn
7,093,645 B2 8/2006 Grunstra et al.
7,108,045 B2 9/2006 Wiedemer et al.
7,109,822 B2 9/2006 Perkins et al.
7,174,945 B2 2/2007 Beals et al.
7,185,695 B1 3/2007 Santeler
7,207,375 B2 4/2007 Turkington et al.
7,234,506 B2 6/2007 Grunstra et al.
7,237,375 B2 7/2007 Humcke et al.
7,237,595 B2 7/2007 Beck et al.
7,240,718 B2 7/2007 Schmidt et al.
7,243,700 B2 7/2007 Beals et al.
7,246,652 B2 7/2007 Fowler
7,270,170 B2 9/2007 Beals et al.
7,270,173 B2 9/2007 Wiedemer et al.
7,278,460 B2 10/2007 Grunstra et al.
7,278,463 B2 10/2007 Snyder et al.
7,306,026 B2 12/2007 Memmen
7,322,795 B2 1/2008 Luczak et al.
7,325,587 B2 2/2008 Memmen
7,334,625 B2 2/2008 Judge et al.
7,343,730 B2 3/2008 Humcke et al.
7,371,043 B2 5/2008 Keller
7,371,049 B2 5/2008 Cunha et al.
7,377,746 B2 5/2008 Brassfield et al.
7,410,342 B2 8/2008 Matheny
7,438,118 B2 10/2008 Santeler
7,448,433 B2 11/2008 Ortiz et al.
7,448,434 B2 11/2008 Turkington et al.
7,461,684 B2 12/2008 Liu et al.
7,478,994 B2 1/2009 Cunha et al.
7,517,225 B2 4/2009 Cherian
7,575,039 B2 8/2009 Beals et al.
7,588,069 B2 9/2009 Munz et al.
7,624,787 B2 12/2009 Lee et al.
7,625,172 B2 12/2009 Walz et al.
7,673,669 B2 3/2010 Snyder et al.
7,686,065 B2 3/2010 Luczak
7,713,029 B1 5/2010 Davies
7,717,676 B2 5/2010 Cunha et al.
7,722,327 B1 5/2010 Liang
7,802,613 B2 5/2010 Bullied et al.
7,727,495 B2 6/2010 Burd et al.

(56) References Cited

U.S. PATENT DOCUMENTS 7,731,481 B2 6/2010 Cunha et al.
7,753,104 B2 7/2010 Luczak et al.
7,757,745 B2 7/2010 Luczak
7,771,210 B2 8/2010 Cherian
7,779,892 B2 8/2010 Luczak et al.
7,789,626 B1 9/2010 Liang
7,798,201 B2 9/2010 Bewlay et al.
7,806,681 B2 10/2010 Feick et al.
7,861,766 B2 1/2011 Bochiechio et al.
7,882,884 B2 2/2011 Beals et al.
7,938,168 B2 5/2011 Lee et al.
7,947,233 B2 5/2011 Burd et al.
7,963,085 B2 6/2011 Sypeck et al.
7,993,106 B2 8/2011 Walters
8,057,183 B1 11/2011 Liang
8,066,483 B1 11/2011 Liang
8,100,165 B2 1/2012 Piggush et al.
8,113,780 B2 2/2012 Cherolis et al.
8,122,583 B2 2/2012 Luczak et al.
8,137,068 B2 3/2012 Surace et al.
8,162,609 B1 4/2012 Liang
8,167,537 B1 5/2012 Plank et al.
8,171,978 B2 5/2012 Propheter-Hinckley et al.
8,181,692 B2 5/2012 Frasier et al.
8,196,640 B1 6/2012 Paulus et al.
8,251,123 B2 8/2012 Farris et al.
8,251,660 B1 8/2012 Liang
8,261,810 B1 9/2012 Liang
8,291,963 B1 10/2012 Trinks et al.
8,297,455 B2 10/2012 Smyth
8,302,668 B1 11/2012 Bullied et al.
8,303,253 B1 11/2012 Liang
8,307,654 B1 11/2012 Liang
8,317,475 B1 11/2012 Downs
8,322,988 B1 12/2012 Downs et al.
8,336,606 B2 12/2012 Piggush
8,342,802 B1 1/2013 Liang
8,366,394 B1 2/2013 Liang
8,381,923 B2 2/2013 Smyth
8,414,263 B1 4/2013 Liang
8,500,401 B1 8/2013 Liang
8,506,256 B1 8/2013 Brostmeyer et al.
8,535,004 B2 9/2013 Campbell
8,622,113 B1 1/2014 Rau, III
8,678,766 B1 3/2014 Liang
8,734,108 B1 5/2014 Liang
8,753,083 B2 6/2014 Lacy et al.
8,770,931 B2 7/2014 Alvanos et al.
8,777,571 B1 7/2014 Liang
8,793,871 B2 8/2014 Morrison et al.
8,794,298 B2 8/2014 Schlienger et al.
8,807,943 B1 8/2014 Liang
8,813,812 B2 8/2014 Ellgass et al.
8,813,824 B2 8/2014 Appleby et al.
8,858,176 B1 10/2014 Liang
8,864,469 B1 10/2014 Liang
8,870,524 B1 10/2014 Liang
8,876,475 B1 11/2014 Liang
8,893,767 B2 11/2014 Mueller et al.
8,899,303 B2 12/2014 Mueller et al.
8,906,170 B2 12/2014 Gigliotti, Jr. et al.
8,911,208 B2 12/2014 Propheter-Hinckley et al.
8,915,289 B2 12/2014 Mueller et al.
8,936,068 B2 1/2015 Lee et al.
8,940,114 B2 1/2015 James et al.
8,969,760 B2 3/2015 Hu et al.
8,978,385 B2 3/2015 Cunha
8,993,923 B2 3/2015 Hu et al.
8,997,836 B2 4/2015 Mueller et al.
9,038,706 B2 5/2015 Hillier
9,051,838 B2 6/2015 Wardle et al.
9,057,277 B2 6/2015 Appleby et al.
9,057,523 B2 6/2015 Cunha et al.
9,061,350 B2 6/2015 Bewlay et al.
9,079,241 B2 7/2015 Barber et al.
9,079,803 B2 7/2015 Xu
9,174,271 B2 11/2015 Newton et al.
2001/0044651 A1 11/2001 Steinke et al.
2002/0029567 A1 3/2002 Kamen et al.
2002/0182056 A1 12/2002 Widrig et al.
2002/0187065 A1 12/2002 Amaya et al.
2002/0190039 A1 12/2002 Steibel et al.
2002/0197161 A1 12/2002 Roeloffs et al.
2003/0047197 A1 3/2003 Beggs et al.
2003/0062088 A1 4/2003 Perla
2003/0133799 A1 7/2003 Widrig et al.
2003/0150092 A1 8/2003 Corderman et al.
2003/0199969 A1 10/2003 Steinke et al.
2003/0201087 A1 10/2003 Devine et al.
2004/0024470 A1 2/2004 Giordano et al.
2004/0055725 A1 3/2004 Ray et al.
2004/0056079 A1 3/2004 Srinivasan
2004/0144089 A1 7/2004 Kamen et al.
2004/0154252 A1 8/2004 Sypeck et al.
2004/0159985 A1 8/2004 Altoonian et al.
2005/0006047 A1 1/2005 Wang et al.
2005/0016706 A1 1/2005 Ray et al.
2005/0087319 A1 4/2005 Beals et al.
2005/0133193 A1 6/2005 Beals et al.
2005/0247429 A1 11/2005 Turkington et al.
2006/0032604 A1 2/2006 Beck et al.
2006/0048553 A1 3/2006 Almquist
2006/0065383 A1 3/2006 Ortiz et al.
2006/0107668 A1 5/2006 Cunha et al.
2006/0118262 A1 6/2006 Beals et al.
2006/0118990 A1 6/2006 Dierkes et al.
2006/0237163 A1 10/2006 Turkington et al.
2006/0283168 A1 12/2006 Humcke et al.
2007/0044936 A1 3/2007 Memmen
2007/0059171 A1 3/2007 Simms et al.
2007/0107412 A1 5/2007 Humcke et al.
2007/0114001 A1 5/2007 Snyder et al.
2007/0116972 A1 5/2007 Persky
2007/0169605 A1 7/2007 Szymanski
2007/0177975 A1 8/2007 Luczak et al.
2007/0253816 A1 11/2007 Walz et al.
2008/0003849 A1 1/2008 Cherian
2008/0080979 A1 4/2008 Brassfield et al.
2008/0131285 A1 6/2008 Albert et al.
2008/0135718 A1 6/2008 Lee et al.
2008/0138208 A1 6/2008 Walters
2008/0138209 A1 6/2008 Cunha et al.
2008/0145235 A1 6/2008 Cunha et al.
2008/0169412 A1 7/2008 Snyder et al.
2008/0190582 A1 8/2008 Lee et al.
2009/0041587 A1 2/2009 Konter et al.
2009/0095435 A1 4/2009 Luczak et al.
2009/0181560 A1 7/2009 Cherian
2009/0255742 A1 10/2009 Hansen
2010/0021643 A1 1/2010 Lane et al.
2010/0150733 A1 6/2010 Abdel-Messeh et al.
2010/0200189 A1 8/2010 Qi et al.
2010/0219325 A1 9/2010 Bullied et al.
2010/0276103 A1 11/2010 Bullied et al.
2010/0304064 A1 12/2010 Huttner
2011/0048665 A1 3/2011 Schlienger et al.
2011/0068077 A1 3/2011 Smyth
2011/0132563 A1 6/2011 Merrill et al.
2011/0132564 A1 6/2011 Merrill et al.
2011/0135446 A1 6/2011 Dube et al.
2011/0146075 A1 6/2011 Hazel et al.
2011/0150666 A1 6/2011 Hazel et al.
2011/0189440 A1 8/2011 Appleby et al.
2011/0236221 A1 9/2011 Campbell
2011/0240245 A1 10/2011 Schlienger et al.
2011/0250078 A1 10/2011 Bruce et al.
2011/0250385 A1 10/2011 Sypeck et al.
2011/0293434 A1 12/2011 Lee et al.
2011/0315337 A1 12/2011 Piggush
2012/0161498 A1 6/2012 Hansen
2012/0163995 A1 6/2012 Wardle et al.
2012/0168108 A1 7/2012 Farris et al.
2012/0183412 A1 7/2012 Lacy et al.
2012/0186681 A1 7/2012 Sun et al.

(56) References Cited

U.S. PATENT DOCUMENTS

| | | | |
|---|---|---|---|
| 2012/0186768 | A1 | 7/2012 | Sun et al. |
| 2012/0193841 | A1 | 8/2012 | Wang et al. |
| 2012/0237786 | A1 | 9/2012 | Morrison et al. |
| 2012/0276361 | A1 | 11/2012 | James et al. |
| 2012/0298321 | A1 | 11/2012 | Smyth |
| 2013/0019604 | A1 | 1/2013 | Cunha et al. |
| 2013/0025287 | A1 | 1/2013 | Cunha |
| 2013/0025288 | A1 | 1/2013 | Cunha et al. |
| 2013/0064676 | A1 | 3/2013 | Salisbury et al. |
| 2013/0139990 | A1 | 6/2013 | Appleby et al. |
| 2013/0177448 | A1 | 7/2013 | Spangler |
| 2013/0220571 | A1 | 8/2013 | Mueller et al. |
| 2013/0266816 | A1 | 10/2013 | Xu |
| 2013/0280093 | A1 | 10/2013 | Zelesky et al. |
| 2013/0318771 | A1 | 12/2013 | Luczak et al. |
| 2013/0323033 | A1 | 12/2013 | Lutjen et al. |
| 2013/0327602 | A1 | 12/2013 | Barber et al. |
| 2013/0333855 | A1 | 12/2013 | Merrill et al. |
| 2013/0338267 | A1 | 12/2013 | Appleby et al. |
| 2014/0023497 | A1 | 1/2014 | Giglio et al. |
| 2014/0031458 | A1 | 1/2014 | Jansen |
| 2014/0033736 | A1 | 2/2014 | Propheter-Hinckley et al. |
| 2014/0068939 | A1 | 3/2014 | Devine, II et al. |
| 2014/0076857 | A1 | 3/2014 | Hu et al. |
| 2014/0076868 | A1 | 3/2014 | Hu et al. |
| 2014/0093387 | A1 | 4/2014 | Pointon et al. |
| 2014/0140860 | A1 | 5/2014 | Tibbott et al. |
| 2014/0169981 | A1 | 6/2014 | Bales et al. |
| 2014/0199177 | A1 | 7/2014 | Propheter-Hinckley et al. |
| 2014/0202650 | A1 | 7/2014 | Song et al. |
| 2014/0284016 | A1 | 9/2014 | Vander Wal |
| 2014/0311315 | A1 | 10/2014 | Isaac |
| 2014/0314581 | A1 | 10/2014 | McBrien et al. |
| 2014/0342175 | A1 | 11/2014 | Morrison et al. |
| 2014/0342176 | A1 | 11/2014 | Appleby et al. |
| 2014/0356560 | A1 | 12/2014 | Prete et al. |
| 2014/0363305 | A1 | 12/2014 | Shah et al. |
| 2015/0053365 | A1 | 2/2015 | Mueller et al. |
| 2015/0174653 | A1 | 6/2015 | Verner et al. |
| 2015/0184857 | A1 | 7/2015 | Cunha et al. |
| 2015/0306657 | A1 | 10/2015 | Frank |

FOREIGN PATENT DOCUMENTS

| | | | |
|---|---|---|---|
| EP | 0025481 | B1 | 2/1983 |
| EP | 0111600 | A1 | 6/1984 |
| EP | 0190114 | A1 | 8/1986 |
| EP | 0319244 | A2 | 6/1989 |
| EP | 0324229 | A2 | 7/1989 |
| EP | 0324229 | B1 | 7/1992 |
| EP | 0539317 | A1 | 4/1993 |
| EP | 0556946 | A1 | 8/1993 |
| EP | 0559251 | A1 | 9/1993 |
| EP | 0585183 | A1 | 3/1994 |
| EP | 0319244 | B1 | 5/1994 |
| EP | 0661246 | A1 | 7/1995 |
| EP | 0539317 | B1 | 11/1995 |
| EP | 0715913 | A1 | 6/1996 |
| EP | 0725606 | A1 | 8/1996 |
| EP | 0750956 | A2 | 1/1997 |
| EP | 0750957 | A1 | 1/1997 |
| EP | 0792409 | A1 | 9/1997 |
| EP | 0691894 | B1 | 10/1997 |
| EP | 0805729 | A2 | 11/1997 |
| EP | 0818256 | A1 | 1/1998 |
| EP | 0556946 | B1 | 4/1998 |
| EP | 0559251 | B1 | 12/1998 |
| EP | 0585183 | B1 | 3/1999 |
| EP | 0899039 | A2 | 3/1999 |
| EP | 0750956 | B1 | 5/1999 |
| EP | 0661246 | B1 | 9/1999 |
| EP | 0725606 | B1 | 12/1999 |
| EP | 0968062 | A1 | 1/2000 |
| EP | 0805729 | B1 | 8/2000 |
| EP | 1055800 | A2 | 11/2000 |
| EP | 1070829 | A2 | 1/2001 |
| EP | 1124509 | A1 | 8/2001 |
| EP | 1142658 | A1 | 10/2001 |
| EP | 1161307 | A1 | 12/2001 |
| EP | 1163970 | A1 | 12/2001 |
| EP | 1178769 | A1 | 2/2002 |
| EP | 0715913 | B1 | 4/2002 |
| EP | 0968062 | B1 | 5/2002 |
| EP | 0951579 | B1 | 1/2003 |
| EP | 1284338 | A2 | 2/2003 |
| EP | 0750957 | B1 | 3/2003 |
| EP | 1341481 | A2 | 9/2003 |
| EP | 1358958 | A1 | 11/2003 |
| EP | 1367224 | A1 | 12/2003 |
| EP | 0818256 | B1 | 2/2004 |
| EP | 1124509 | B1 | 3/2004 |
| EP | 1425483 | A2 | 6/2004 |
| EP | 1055800 | B1 | 10/2004 |
| EP | 1163970 | B1 | 3/2005 |
| EP | 1358958 | B1 | 3/2005 |
| EP | 1519116 | A1 | 3/2005 |
| EP | 1531019 | A1 | 5/2005 |
| EP | 0899039 | B1 | 11/2005 |
| EP | 1604753 | A1 | 12/2005 |
| EP | 1659264 | A2 | 5/2006 |
| EP | 1178769 | B1 | 7/2006 |
| EP | 1382403 | B1 | 9/2006 |
| EP | 1759788 | A2 | 3/2007 |
| EP | 1764171 | A1 | 3/2007 |
| EP | 1813775 | A2 | 8/2007 |
| EP | 1815923 | A1 | 8/2007 |
| EP | 1849965 | A2 | 10/2007 |
| EP | 1070829 | B1 | 1/2008 |
| EP | 1142658 | B1 | 3/2008 |
| EP | 1927414 | A2 | 6/2008 |
| EP | 1930097 | A1 | 6/2008 |
| EP | 1930098 | A1 | 6/2008 |
| EP | 1930099 | A1 | 6/2008 |
| EP | 1932604 | A1 | 6/2008 |
| EP | 1936118 | A2 | 6/2008 |
| EP | 1939400 | A2 | 7/2008 |
| EP | 1984162 | A1 | 10/2008 |
| EP | 1604753 | B1 | 11/2008 |
| EP | 2000234 | A2 | 12/2008 |
| EP | 2025869 | A1 | 2/2009 |
| EP | 1531019 | B1 | 3/2010 |
| EP | 2212040 | A1 | 8/2010 |
| EP | 2246133 | A1 | 11/2010 |
| EP | 2025869 | B1 | 12/2010 |
| EP | 2335845 | A1 | 6/2011 |
| EP | 2336493 | A2 | 6/2011 |
| EP | 2336494 | A2 | 6/2011 |
| EP | 1930097 | B1 | 7/2011 |
| EP | 2362822 | A2 | 9/2011 |
| EP | 2366476 | A1 | 9/2011 |
| EP | 2392774 | A1 | 12/2011 |
| EP | 1930098 | B1 | 2/2012 |
| EP | 2445668 | A2 | 5/2012 |
| EP | 2445669 | A2 | 5/2012 |
| EP | 2461922 | A1 | 6/2012 |
| EP | 1659264 | B1 | 11/2012 |
| EP | 2519367 | A2 | 11/2012 |
| EP | 2537606 | A1 | 12/2012 |
| EP | 1927414 | B1 | 1/2013 |
| EP | 2549186 | A2 | 1/2013 |
| EP | 2551592 | A2 | 1/2013 |
| EP | 2551593 | A2 | 1/2013 |
| EP | 2559533 | A2 | 2/2013 |
| EP | 2559534 | A2 | 2/2013 |
| EP | 2559535 | A2 | 2/2013 |
| EP | 2576099 | A1 | 4/2013 |
| EP | 2000234 | B1 | 7/2013 |
| EP | 2614902 | A2 | 7/2013 |
| EP | 2650062 | A2 | 10/2013 |
| EP | 2246133 | B1 | 7/2014 |
| EP | 2366476 | B1 | 7/2014 |
| EP | 2777841 | A1 | 9/2014 |
| EP | 1849965 | B1 | 2/2015 |
| EP | 2834031 | A2 | 2/2015 |

(56) References Cited

FOREIGN PATENT DOCUMENTS

| | | | | | |
|---|---|---|---|---|---|
| EP | 1341481 | B1 | | 3/2015 | |
| EP | 2841710 | A1 | | 3/2015 | |
| EP | 2855857 | A2 | | 4/2015 | |
| EP | 2880276 | A1 | | 6/2015 | |
| EP | 2937161 | A1 | | 10/2015 | |
| GB | 731292 | A | | 6/1955 | |
| GB | 800228 | A | | 8/1958 | |
| GB | 2102317 | A | | 2/1983 | |
| GB | 2118078 | A | | 10/1983 | |
| JP | 5-330957 | A | * | 12/1993 | ..... B22C 9/10 |
| JP | H1052731 | A | | 2/1998 | |
| WO | 9615866 | A1 | | 5/1996 | |
| WO | 9618022 | A1 | | 6/1996 | |
| WO | 2010036801 | A2 | | 4/2010 | |
| WO | 2010040746 | A1 | | 4/2010 | |
| WO | 2010151833 | A2 | | 12/2010 | |
| WO | 2010151838 | A2 | | 12/2010 | |
| WO | 2011019667 | A1 | | 2/2011 | |
| WO | 2013163020 | A1 | | 10/2013 | |
| WO | 2014011262 | A2 | | 1/2014 | |
| WO | 2014022255 | A1 | | 2/2014 | |
| WO | 2014028095 | A2 | | 2/2014 | |
| WO | 2014093826 | A2 | | 6/2014 | |
| WO | 2014105108 | A1 | | 7/2014 | |
| WO | 2014109819 | A1 | | 7/2014 | |
| WO | 2014133635 | A2 | | 9/2014 | |
| WO | 2014179381 | A1 | | 11/2014 | |
| WO | 2015006026 | A1 | | 1/2015 | |
| WO | 2015006440 | A1 | | 1/2015 | |
| WO | 2015006479 | A1 | | 1/2015 | |
| WO | 2015009448 | A1 | | 1/2015 | |
| WO | 2015042089 | A1 | | 3/2015 | |
| WO | 2015050987 | A1 | | 4/2015 | |
| WO | 2015053833 | A1 | | 4/2015 | |
| WO | 2015073068 | A1 | | 5/2015 | |
| WO | 2015073657 | A1 | | 5/2015 | |
| WO | 2015080854 | A1 | | 6/2015 | |
| WO | 2015094636 | A1 | | 6/2015 | |

OTHER PUBLICATIONS

European Search Report and Opinion issued in connection with related EP Application No. 16204602.3 dated May 12, 2017.

European Search Report and Opinion issued in connection with related EP Application No. 16204609.8 dated May 12, 2017.

European Search Report and Opinion issued in connection with related EP Application No. 16204610.6 dated May 17, 2017.

European Search Report and Opinion issued in connection with related EP Application No. 16204613.0 dated May 22, 2017.

European Search Report and Opinion issued in connection with related EP Application No. 16204605.6 dated May 26, 2017.

European Search Report and Opinion issued in connection with related EP Application No. 16204607.2 dated May 26, 2017.

European Search Report and Opinion issued in connection with related EP Application No. 16204608.0 dated May 26, 2017.

European Search Report and Opinion issued in connection with corresponding EP Application No. 16204617.1 dated May 26, 2017.

European Search Report and Opinion issued in connection with related EP Application No. 16204614.8.0 dated Jun. 2, 2017.

Liu et al, "Effect of nickel coating on bending properties of stereolithography photo-polymer SL5195", Materials & Design, vol. 26, Issue 6, pp. 493-496, 2005.

Ziegelheim, J. et al., "Diffusion bondability of similar/dissimilar light metal sheets," Journal of Materials Processing Technology 186.1 (May 2007): 87-93.

European Search Report and Opinion issued in connection with related EP Application No. 17168418.6 dated Aug. 10, 2017.

* cited by examiner

METHOD AND ASSEMBLY FOR FORMING COMPONENTS HAVING INTERNAL PASSAGES USING A JACKETED CORE

BACKGROUND

The field of the disclosure relates generally to components having an internal passage defined therein, and more particularly to forming such components having the internal passage lined with a coating.

Some components require an internal passage to be defined therein, for example, in order to perform an intended function. For example, but not by way of limitation, some components, such as hot gas path components of gas turbines, are subjected to high temperatures. At least some such components have internal passages defined therein to receive a flow of a cooling fluid, such that the components are better able to withstand the high temperatures. For another example, but not by way of limitation, some components are subjected to friction at an interface with another component. At least some such components have internal passages defined therein to receive a flow of a lubricant to facilitate reducing the friction.

At least some known components having an internal passage defined therein exhibit improved performance of the intended function after a coating is applied to an interior wall that defines the internal passage. For example, but not by way of limitation, some such components are subjected to oxidizing and/or corrosive environments, and oxidation and/or corrosion of the interior wall unfavorably alters flow characteristics of the internal passage. For at least some such components, a coating on the interior wall to inhibit oxidation and/or corrosion improves a performance and/or a useful operating lifespan of the component. However, such coatings can be difficult or cost-prohibitive to apply completely and/or evenly to certain internal passageways, such as, but not limited to, internal passageways characterized by a high degree of nonlinearity, a complex cross-section, and/or a large length-to-diameter ratio.

BRIEF DESCRIPTION

In one aspect, a mold assembly for use in forming a component having an internal passage defined therein is provided. The mold assembly includes a mold defining a mold cavity therein, and a jacketed core positioned with respect to the mold. The jacketed core includes a hollow structure, and an inner core disposed within the hollow structure and positioned to define the internal passage within the component when a component material in a molten state is introduced into the mold cavity and cooled to form the component. The jacketed core also includes a first coating layer disposed between the hollow structure and the inner core.

In another aspect, a method of forming a component having an internal passage defined therein is provided. The method includes positioning a jacketed core with respect to a mold. The jacketed core includes a hollow structure, an inner core disposed within the hollow structure, and a first coating layer disposed between the hollow structure and the inner core. The first coating layer is formed from a first coating material. The method also includes introducing a component material in a molten state into a cavity of the mold, and cooling the component material in the cavity to form the component. The inner core is positioned to define the internal passage within the component, and at least a portion of the first coating material lines at least a portion of the internal passage.

DRAWINGS

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms such as "about," "approximately," and "substantially" is not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise.

The exemplary components and methods described herein overcome at least some of the disadvantages associated with known assemblies and methods for forming a component having a coated internal passage defined therein. The embodiments described herein provide a jacketed core positioned with respect to a mold. The jacketed core includes (i) a hollow structure, (ii) an inner core disposed within the hollow structure, and (iii) a first coating layer disposed between the hollow structure and the inner core. The inner core extends within the mold cavity to define a position of the internal passage within the component to be formed in the mold. The first coating layer includes a first coating material. After a molten component material is introduced into the mold cavity and cooled to form the component, at least a portion of the first coating material lines at least a portion of the internal passage.

Figure 1:
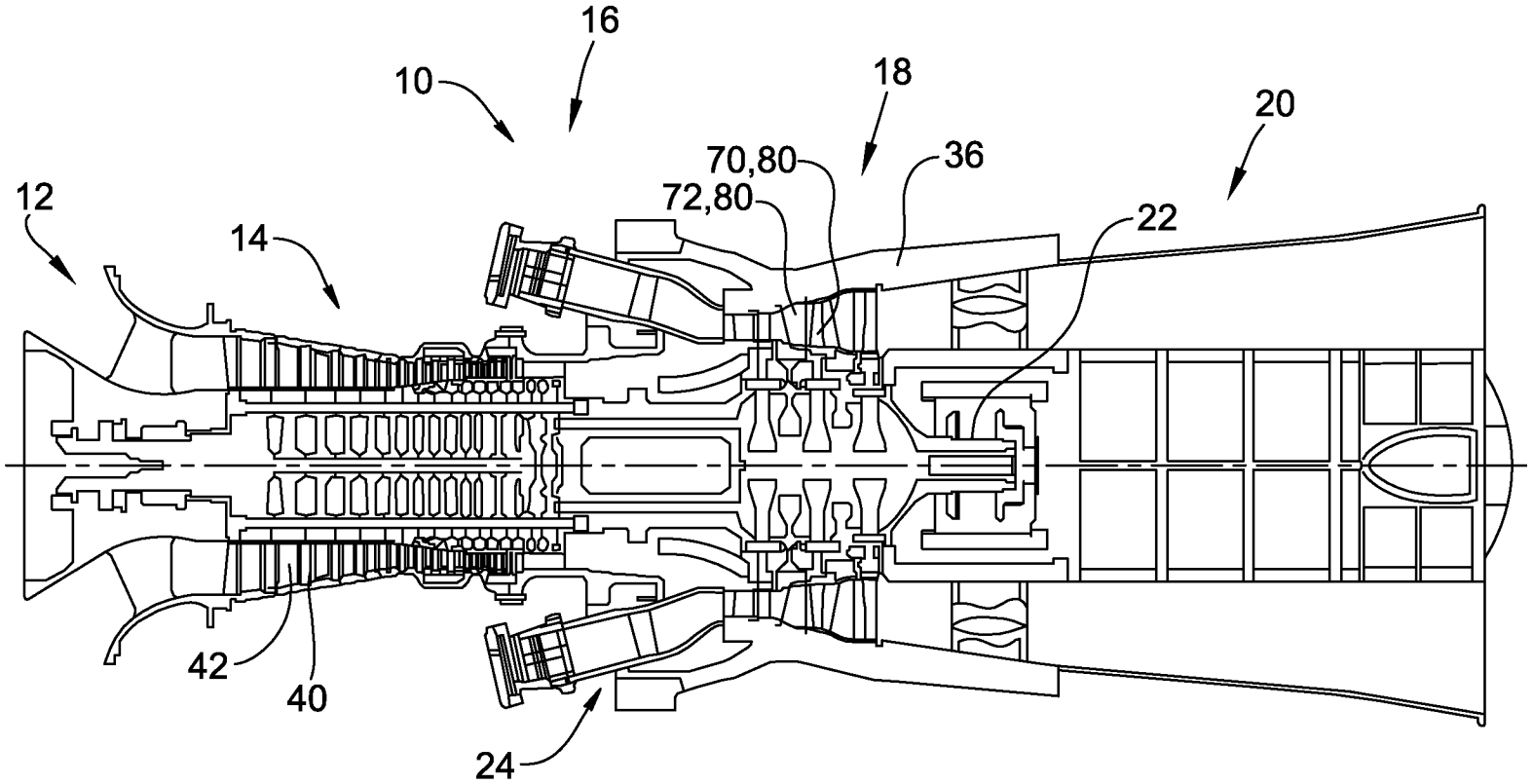
FIG. 1 is a schematic diagram of an exemplary rotary machine.

FIG. 1 is a schematic view of an exemplary rotary machine 10 having components for which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any rotary machine for which components formed with internal passages as described herein are suitable. Moreover, although embodiments of the present disclosure are described in the context of a rotary machine for purposes of illustration, it should be understood that the embodiments described herein are applicable in any context that involves a component suitably formed with an internal passage defined therein.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of gas turbine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts the thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20. Components of rotary machine 10 are designated as components 80. Components 80 proximate a path of the combustion gases are subjected to high temperatures during operation of rotary machine 10. Additionally or alternatively, components 80 include any component suitably formed with an internal passage defined therein.

Figure 2:
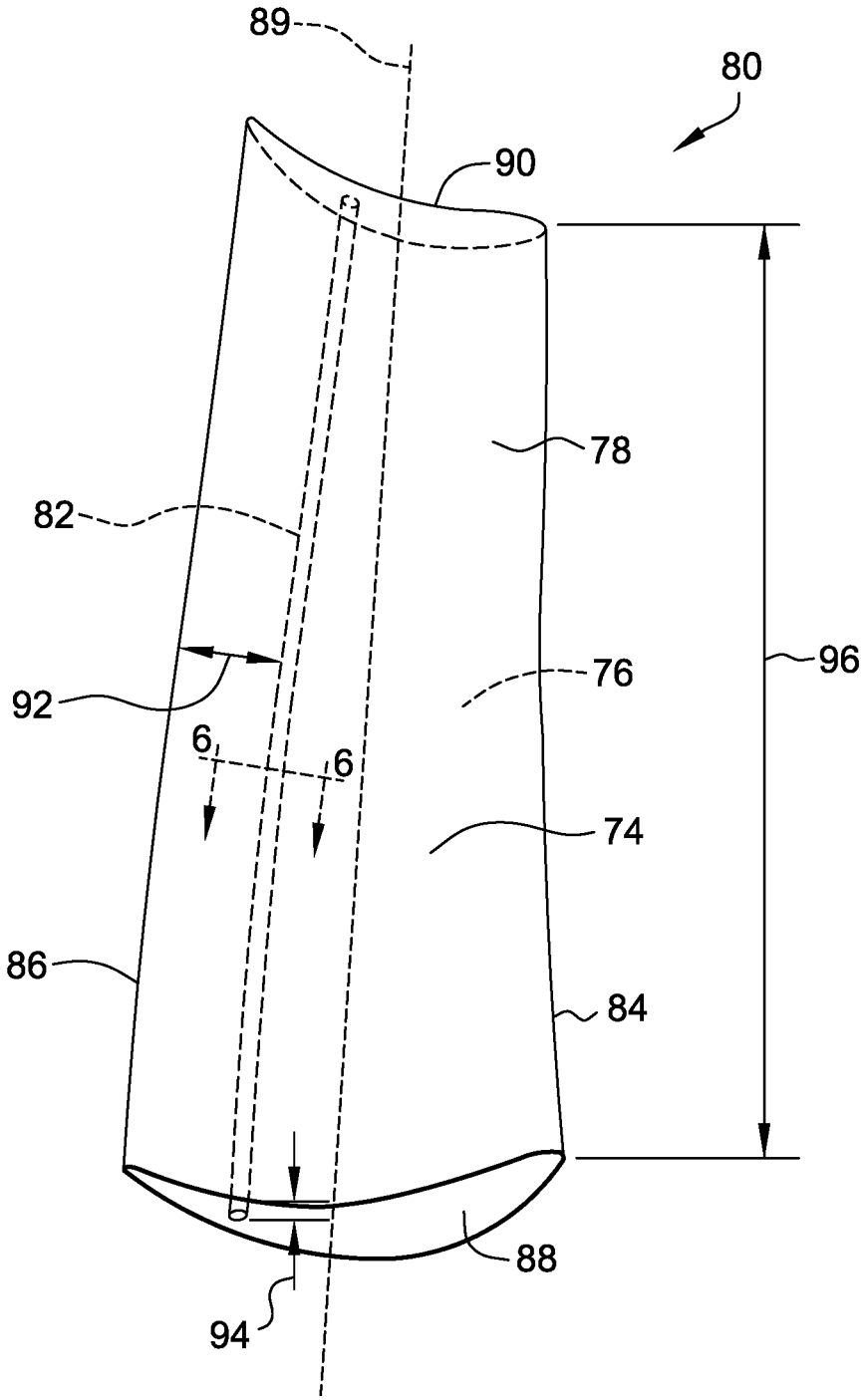
FIG. 2 is a schematic perspective view of an exemplary component for use with the rotary machine shown in FIG. 1.

FIG. 2 is a schematic perspective view of an exemplary component 80, illustrated for use with rotary machine 10 (shown in FIG. 1). Component 80 includes at least one internal passage 82 defined therein by an interior wall 100. For example, a cooling fluid is provided to internal passage 82 during operation of rotary machine 10 to facilitate maintaining component 80 below a temperature of the hot combustion gases. Although only one internal passage 82 is illustrated, it should be understood that component 80 includes any suitable number of internal passages 82 formed as described herein.

Component 80 is formed from a component material 78. In the exemplary embodiment, component material 78 is a suitable nickel-based superalloy. In alternative embodiments, component material 78 is at least one of a cobalt-based superalloy, an iron-based alloy, and a titanium-based alloy. In other alternative embodiments, component material 78 is any suitable material that enables component 80 to be formed as described herein.

In the exemplary embodiment, component 80 is one of rotor blades 70 or stator vanes 72. In alternative embodiments, component 80 is another suitable component of rotary machine 10 that is capable of being formed with an internal passage as described herein. In still other embodiments, component 80 is any component for any suitable application that is suitably formed with an internal passage defined therein.

In the exemplary embodiment, rotor blade 70, or alternatively stator vane 72, includes a pressure side 74 and an opposite suction side 76. Each of pressure side 74 and suction side 76 extends from a leading edge 84 to an opposite trailing edge 86. In addition, rotor blade 70, or alternatively stator vane 72, extends from a root end 88 to an opposite tip end 90, defining a blade length 96. In alternative embodiments, rotor blade 70, or alternatively stator vane 72, has any suitable configuration that is capable of being formed with an internal passage as described herein.

In certain embodiments, blade length 96 is at least about 25.4 centimeters (cm) (10 inches). Moreover, in some embodiments, blade length 96 is at least about 50.8 cm (20 inches). In particular embodiments, blade length 96 is in a range from about 61 cm (24 inches) to about 101.6 cm (40 inches). In alternative embodiments, blade length 96 is less than about 25.4 cm (10 inches). For example, in some embodiments, blade length 96 is in a range from about 2.54 cm (1 inch) to about 25.4 cm (10 inches). In other alternative embodiments, blade length 96 is greater than about 101.6 cm (40 inches).

In the exemplary embodiment, internal passage 82 extends from root end 88 to tip end 90. In alternative embodiments, internal passage 82 extends within component 80 in any suitable fashion, and to any suitable extent, that enables internal passage 82 to be formed as described herein. In certain embodiments, internal passage 82 is non-linear. For example, component 80 is formed with a predefined twist along an axis 89 defined between root end 88 and tip end 90, and internal passage 82 has a curved shape complementary to the axial twist. In some embodiments, internal passage 82 is positioned at a substantially constant distance 94 from pressure side 74 along a length of internal passage 82. Alternatively or additionally, a chord of component 80 tapers between root end 88 and tip end 90, and internal passage 82 extends nonlinearly complementary to the taper, such that internal passage 82 is positioned at a substantially constant distance 92 from trailing edge 86 along the length of internal passage 82. In alternative embodiments, internal passage 82 has a nonlinear shape that is complementary to any suitable contour of component 80. In other alternative embodiments, internal passage 82 is nonlinear and other than complementary to a contour of component 80. In some embodiments, internal passage 82 having a nonlinear shape facilitates satisfying a preselected cooling criterion for component 80. In alternative embodiments, internal passage 82 extends linearly.

In some embodiments, internal passage 82 has a substantially circular cross-section. In alternative embodiments, internal passage 82 has a substantially ovoid cross-section. In other alternative embodiments, internal passage 82 has any suitably shaped cross-section that enables internal passage 82 to be formed as described herein. Moreover, in certain embodiments, the shape of the cross-section of internal passage 82 is substantially constant along a length of internal passage 82. In alternative embodiments, the shape of the cross-section of internal passage 82 varies along a length of internal passage 82 in any suitable fashion that enables internal passage 82 to be formed as described herein.

Figure 3:
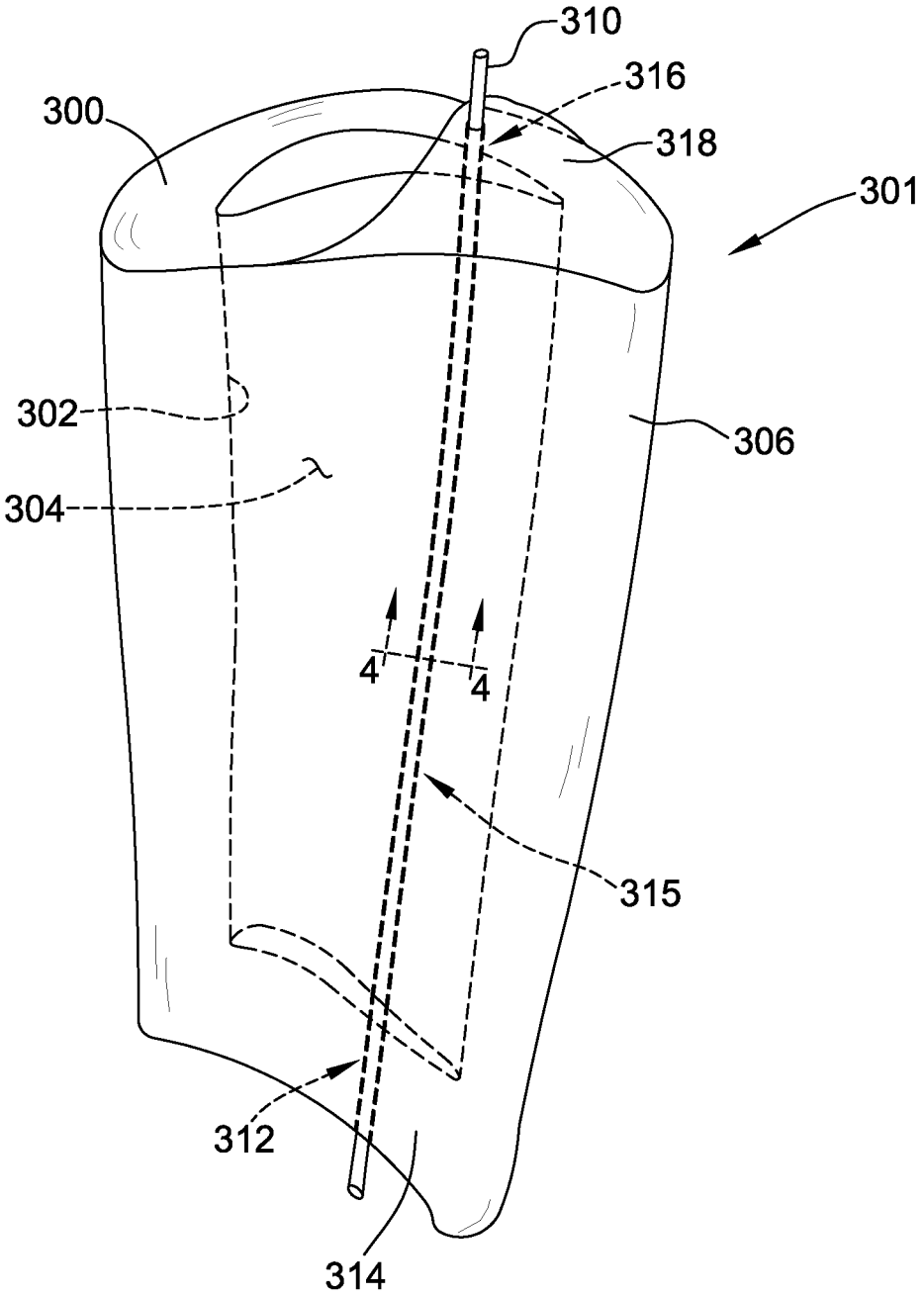
FIG. 3 is a schematic perspective view of an exemplary mold assembly for making the component shown in FIG. 2, the mold assembly including a jacketed core positioned with respect to a mold.
Figure 4:
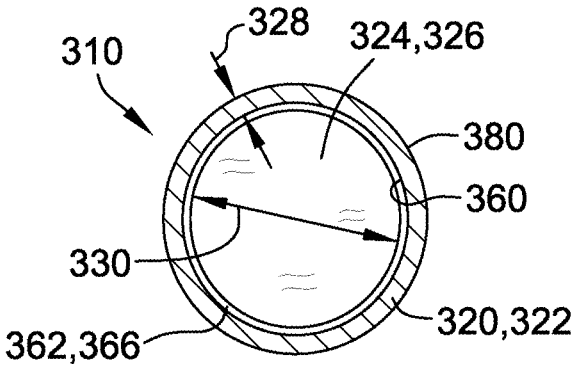
FIG. 4 is a schematic cross-section of an exemplary jacketed core for use with the mold assembly shown in FIG. 3, taken along lines 4-4 shown in FIG. 3.

FIG. 3 is a schematic perspective view of a mold assembly 301 for making component 80 (shown in FIG. 2). Mold assembly 301 includes a jacketed core 310 positioned with respect to a mold 300. FIG. 4 is a schematic cross-section of an embodiment of jacketed core 310 taken along lines 4-4 shown in FIG. 3. With reference to FIGS. 2-4, an interior wall 302 of mold 300 defines a mold cavity 304. Interior wall 302 defines a shape corresponding to an exterior shape of component 80, such that component material 78 in a molten state can be introduced into mold cavity 304 and cooled to form component 80. It should be recalled that, although component 80 in the exemplary embodiment is rotor blade 70 or, alternatively stator vane 72, in alternative embodiments component 80 is any component suitably formable with an internal passage defined therein, as described herein.

Jacketed core 310 is positioned with respect to mold 300 such that a portion 315 of jacketed core 310 extends within mold cavity 304. Jacketed core 310 includes a hollow structure 320 formed from a first material 322, an inner core 324 disposed within hollow structure 320 and formed from an inner core material 326, and at least a first coating layer 362 disposed between hollow structure 320 and inner core 324 and formed from a first coating material 366. More specifically, the at least first coating layer 362 is disposed radially, with respect to a centerline of hollow structure 320, between hollow structure 320 and inner core 324. Inner core 324 is shaped to define a shape of internal passage 82, and inner core 324 of portion 315 of jacketed core 310 positioned within mold cavity 304 defines a position of internal passage 82 within component 80.

Hollow structure 320 includes an outer wall 380 that substantially encloses inner core 324 along a length of inner core 324. An interior portion 360 of hollow structure 320 is located interiorly with respect to outer wall 380, such that inner core 324 is complementarily shaped by interior portion 360 of hollow structure 320. In certain embodiments, hollow structure 320 defines a generally tubular shape. For example, but not by way of limitation, hollow structure 320 is initially formed from a substantially straight metal tube that is suitably manipulated into a nonlinear shape, such as a curved or angled shape, as necessary to define a selected nonlinear shape of inner core 324 and, thus, of internal passage 82. In alternative embodiments, hollow structure 320 defines any suitable shape that enables inner core 324 to define a shape of internal passage 82 as described herein.

In the exemplary embodiment, hollow structure 320 has a wall thickness 328 that is less than a characteristic width 330 of inner core 324. Characteristic width 330 is defined herein as the diameter of a circle having the same cross-sectional area as inner core 324. In alternative embodiments, hollow structure 320 has a wall thickness 328 that is other than less than characteristic width 330. A shape of a cross-section of inner core 324 is circular in the exemplary embodiment shown in FIGS. 3 and 4. Alternatively, the shape of the cross-section of inner core 324 corresponds to any suitable shape of the cross-section of internal passage 82 that enables internal passage 82 to function as described herein.

Also in the exemplary embodiment, first coating layer 362 is disposed on at least a portion of interior portion 360 of hollow structure 320, between hollow structure 320 and inner core 324. In some embodiments, first coating layer material 366 is selected to modify a performance of internal passage 82 after component 80 is formed, as will be described herein. For example, but not by way of limitation, first coating material 366 is selected to inhibit oxidation of component material 78 along interior wall 100. Additionally or alternatively, but not by way of limitation, first coating material 366 is selected to inhibit corrosion of component material 78 along interior wall 100. Additionally or alternatively, but not by way of limitation, first coating material 366 is selected to inhibit deposition of carbon on component material 78 along interior wall 100. Additionally or alternatively, but not by way of limitation, first coating material 366 is selected to provide a thermal barrier for component material 78 along interior wall 100. Additionally or alternatively, but not by way of limitation, first coating material 366 is selected to provide a water vapor barrier for component material 78 along interior wall 100. Additionally or alternatively, but not by way of limitation, first coating material 366 is selected to inhibit wear, such as but not limited to erosion, of component material 78 along interior wall 100. Additionally or alternatively, first coating material 366 is selected to be any suitable material that provides or facilitates any other selected characteristic of internal passage 82 when disposed along interior wall 100.

Figure 5:
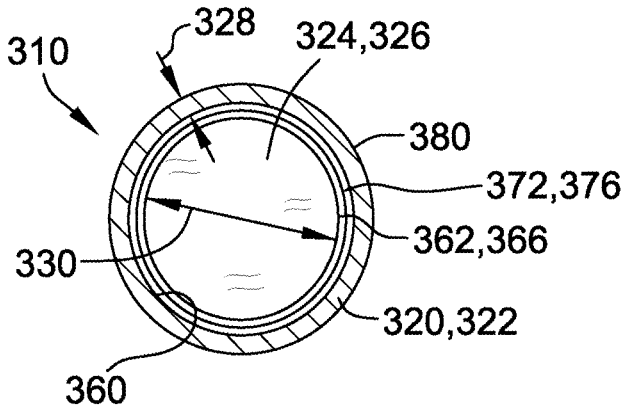
FIG. 5 is a schematic cross-section of another exemplary jacketed core for use with the mold assembly shown in FIG. 3, taken along lines 4-4 shown in FIG. 3.

In certain embodiments, first coating layer 362 is one of a plurality of coating layers disposed between hollow structure 320 and inner core 324. For example, FIG. 5 is a schematic cross-section of another embodiment of jacketed core 310 taken along lines 4-4 shown in FIG. 3. In the exemplary embodiment, jacketed core 310 includes at least a second coating layer 372 disposed on at least a portion of interior portion 360 of hollow structure 320 and formed from a second coating material 376, and first coating layer 362 disposed radially between second coating layer 372 and inner core 324. In some embodiments, first coating layer 362 is formed from first coating material 366 selected from at least one of (i) an oxidation-inhibiting material, (ii) a corrosion-inhibiting material, (iii) a carbon-deposition-inhibiting material, (iv) a thermal barrier material, (v) a water vapor barrier material, and (vi) a wear-inhibiting material, and second coating material 376 is selected from another of (i) an oxidation-inhibiting material, (ii) a corrosion-inhibiting material, (iii) a carbon-deposition-inhibiting material, (iv) a thermal barrier material, (v) a water vapor barrier material, and (vi) a wear-inhibiting material. In alternative embodiments, second coating material 376 is a bond coat material that facilitates bonding of first coating material 366 to at least one of first material 322 and component material 78. In other alternative embodiments, second coating material 376 is any suitable material that enables jacketed core 310 to function as described herein.

With reference to FIGS. 2-5, mold 300 is formed from a mold material 306. In the exemplary embodiment, mold material 306 is a refractory ceramic material selected to withstand a high temperature environment associated with the molten state of component material 78 used to form component 80. In alternative embodiments, mold material 306 is any suitable material that enables component 80 to be formed as described herein. Moreover, in the exemplary embodiment, mold 300 is formed by a suitable investment casting process. For example, but not by way of limitation, a suitable pattern material, such as wax, is injected into a suitable pattern die to form a pattern (not shown) of component 80, the pattern is repeatedly dipped into a slurry of mold material 306 which is allowed to harden to create a shell of mold material 306, and the shell is dewaxed and fired to form mold 300. In alternative embodiments, mold 300 is formed by any suitable method that enables mold 300 to function as described herein.

In certain embodiments, jacketed core 310 is secured relative to mold 300 such that jacketed core 310 remains fixed relative to mold 300 during a process of forming component 80. For example, jacketed core 310 is secured such that a position of jacketed core 310 does not shift during introduction of molten component material 78 into mold cavity 304 surrounding jacketed core 310. In some embodiments, jacketed core 310 is coupled directly to mold 300. For example, in the exemplary embodiment, a tip portion 312 of jacketed core 310 is rigidly encased in a tip portion 314 of mold 300. Additionally or alternatively, a root portion 316 of jacketed core 310 is rigidly encased in a root portion 318 of mold 300 opposite tip portion 314. For example, but not by way of limitation, mold 300 is formed by investment casting as described above, and jacketed core 310 is securely coupled to the suitable pattern die such that tip portion 312 and root portion 316 extend out of the pattern die, while portion 315 extends within a cavity of the die. The pattern material is injected into the die around jacketed core 310 such that portion 315 extends within the pattern. The investment casting causes mold 300 to encase tip portion 312 and/or root portion 316. Additionally or alternatively, jacketed core 310 is secured relative to mold 300 in any other suitable fashion that enables the position of jacketed core 310 relative to mold 300 to remain fixed during a process of forming component 80.

First material 322 is selected to be at least partially absorbable by molten component material 78. In certain embodiments, component material 78 is an alloy, and first material 322 is at least one constituent material of the alloy. For example, in the exemplary embodiment, component material 78 is a nickel-based superalloy, and first material 322 is substantially nickel, such that first material 322 is substantially absorbable by component material 78 when component material 78 in the molten state is introduced into mold cavity 304. In alternative embodiments, component material 78 is any suitable alloy, and first material 322 is at least one material that is at least partially absorbable by the molten alloy. For example, component material 78 is a cobalt-based superalloy, and first material 322 is substantially cobalt. For another example, component material 78 is an iron-based alloy, and first material 322 is substantially iron. For another example, component material 78 is a titanium-based alloy, and first material 322 is substantially titanium.

In certain embodiments, wall thickness 328 is sufficiently thin such that first material 322 of portion 315 of jacketed core 310, that is, the portion that extends within mold cavity 304, is substantially absorbed by component material 78 when component material 78 in the molten state is introduced into mold cavity 304. For example, in some such embodiments, first material 322 is substantially absorbed by component material 78 such that no discrete boundary delineates hollow structure 320 from component material 78 after component material 78 is cooled. Moreover, in some such embodiments, first material 322 is substantially absorbed such that, after component material 78 is cooled, first material 322 is substantially uniformly distributed within component material 78. For example, a concentration of first material 322 proximate inner core 324 is not detectably higher than a concentration of first material 322 at other locations within component 80. For example, and without limitation, first material 322 is nickel and component material 78 is a nickel-based superalloy, and no detectable higher nickel concentration remains proximate inner core 324 after component material 78 is cooled, resulting in a distribution of nickel that is substantially uniform throughout the nickel-based superalloy of formed component 80.

In alternative embodiments, wall thickness 328 is selected such that first material 322 is other than substantially absorbed by component material 78. For example, in some embodiments, after component material 78 is cooled, first material 322 is other than substantially uniformly distributed within component material 78. For example, a concentration of first material 322 proximate inner core 324 is detectably higher than a concentration of first material 322 at other locations within component 80. In some such embodiments, first material 322 is partially absorbed by component material 78 such that a discrete boundary delineates hollow structure 320 from component material 78 after component material 78 is cooled. Moreover, in some such embodiments, first material 322 is partially absorbed by component material 78 such that at least a portion of hollow structure 320 proximate inner core 324 remains intact after component material 78 is cooled.

In some embodiments, first coating material 366 also is at least partially absorbed by component material 78 when component material 78 in the molten state is introduced into mold cavity 304. In some such embodiments, a thickness of first coating layer 362 is selected such that a concentration of first coating material 366 proximate inner core 324 is detectably higher than a concentration of first coating material 366 at other locations within component 80. Thus, after inner core 324 is removed from component 80 to form internal passage 82, the concentration of first coating material 366 proximate interior wall 100 is detectably higher than the concentration of first coating material 366 at other locations within component 80. Moreover, in some such embodiments, at least a portion of first coating material 366 lines at least a portion of interior wall 100 that defines internal passage 82.

Figure 6:
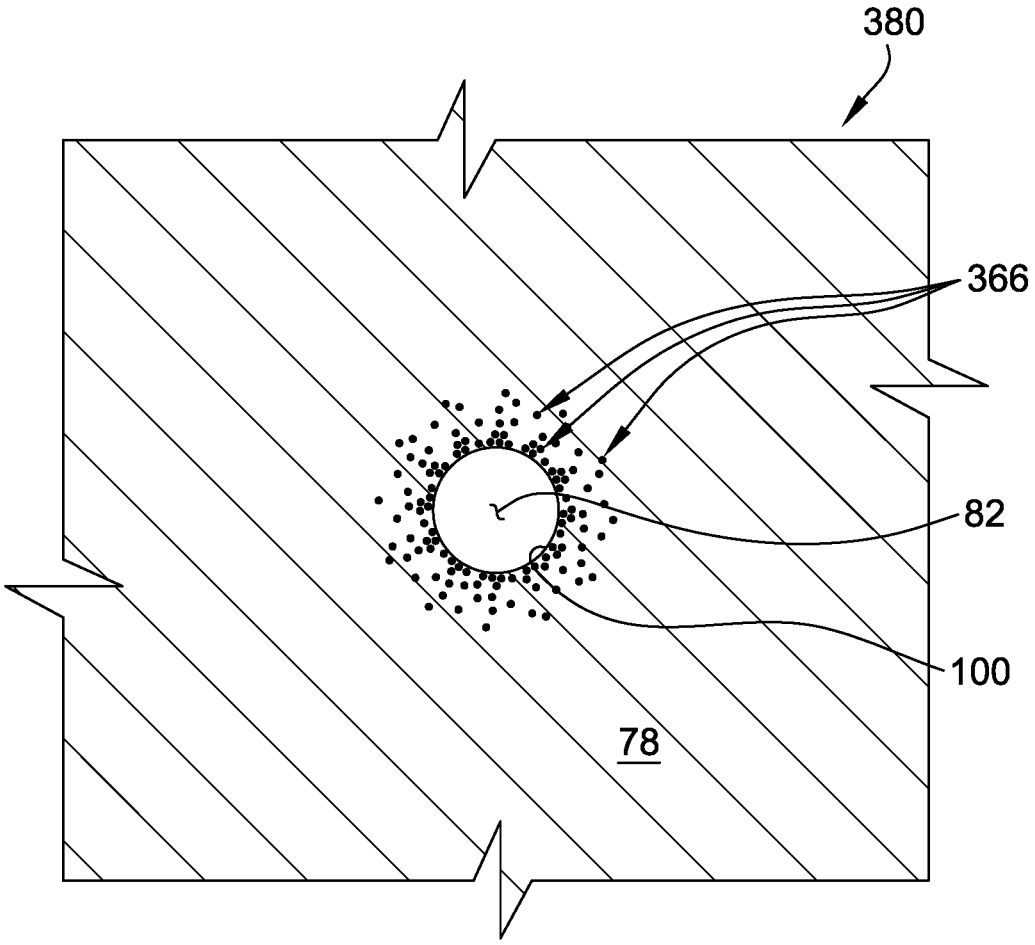
FIG. 6 is a cross-section of the component of FIG. 2, taken along lines 6-6 shown in FIG. 2.

For example, FIG. 6 is a cross-section of component 80 taken along lines 6-6 shown in FIG. 2, and schematically illustrates a gradient distribution of first coating material 366 proximate interior wall 100. In some such embodiments, a concentration of first coating material 366 proximate interior wall 100 is sufficient such that at least a portion of first coating material 366 lines at least a portion of interior wall 100 that defines internal passage 82. For example, the concentration of first coating material 366 proximate interior wall 100 is sufficient to establish material characteristics associated with first coating material 366 along interior wall 100. Thus, first coating layer 362 of jacketed core 310 effectively applies first coating material 366 to internal passage 82 during casting of component 80.

Moreover, in certain embodiments in which first coating layer 362 is one of a plurality of coating layers of jacketed core 310, the additional coating materials, such as, but not limited to, second coating material 376, are distributed proximate interior wall 100 in similar fashion. For example, a concentration of second coating material 376 proximate interior wall 100 is sufficient such that at least a portion of second coating material 376 lines at least a portion of interior wall 100 that defines internal passage 82. For another example, second coating material 376 is a bond coat material, and a concentration of second coating material 376 proximate interior wall 100 is sufficient to bond first coating material 366 to component material 78 and/or first material 322 proximate interior wall 100.

Further, with reference again to FIGS. 2-5, in some embodiments, first coating layer 362 is partially absorbed by component material 78 such that a discrete boundary delineates first coating material 366 from component material 78 after component material 78 is cooled. Moreover, in some such embodiments, first coating layer 362 is partially absorbed by component material 78 such that at least a portion of first coating layer 362 proximate inner core 324 remains intact after component material 78 is cooled. Thus, after inner core 324 is removed from component 80 to form internal passage 82, at least a portion of first coating material 366 lines at least a portion of interior wall 100. Again, first coating layer 362 of jacketed core 310 effectively applies first coating material 366 to internal passage 82 during casting of component 80.

Moreover, in certain embodiments in which first coating layer 362 is one of a plurality of coating layers of jacketed core 310, the additional coating materials, such as, but not limited to, second coating material 376, are delineated by a discrete boundary and/or remain intact proximate interior wall 100 in similar fashion. For example, second coating material 376 is a bond coat material, and a portion of second coating layer 372 that remains intact bonds first coating material 366 to component material 78 and/or first material 322 proximate interior wall 100.

In the exemplary embodiment, inner core material 326 is a refractory ceramic material selected to withstand a high temperature environment associated with the molten state of component material 78 used to form component 80. For example, but without limitation, inner core material 326 includes at least one of silica, alumina, and mullite. Moreover, in the exemplary embodiment, inner core material 326 is selectively removable from component 80 to form internal passage 82. For example, but not by way of limitation, inner core material 326 is removable from component 80 by a suitable process that does not substantially degrade component material 78, such as, but not limited to, a suitable chemical leaching process. In certain embodiments, inner core material 326 is selected based on a compatibility with, and/or a removability from, component material 78. In alternative embodiments, inner core material 326 is any suitable material that enables component 80 to be formed as described herein.

In some embodiments, jacketed core 310 is formed by applying at least first coating layer 362 to interior portion 360 of hollow structure 320, and then filling the coated hollow structure 320 with inner core material 326. For example, in certain embodiments, at least first coating layer 362 is applied to hollow structure 320 in a bulk coating process, such as, but not limited to, a vapor phase deposition process or chemical vapor deposition process. In some such embodiments, outer wall 380 of hollow structure 320 is masked such that only interior portion 360 of hollow structure 320 is coated. Alternatively, outer wall 380 and interior portion 360 are both coated, and the coating on outer wall 380 is, for example, diffused into component material 78 when component 80 is cast. In some such embodiments, applying the coating solely to hollow structure 320 enables bulk deposition processes to be used without a need to position the entirety of component 80 in a deposition chamber, mask an entire outer surface of component 80, and/or needlessly coat a large exterior surface area of component 80, thereby reducing a time and cost required to apply the at least first coating layer 362 as compared to applying the coating to internal passage 82 within component 80 after component 80 is formed.

Additionally or alternatively, in some embodiments, at least first coating layer 362 is applied to interior portion 360 of hollow structure 320 in a slurry injection process, such as, but not limited to, injecting a slurry that includes first coating material 366 and/or its precursors into hollow structure 320, heat treating the slurry to produce first coating layer 362, and then removing the residual slurry from hollow structure 320. In some such embodiments, applying the coating solely to hollow structure 320 enables slurry deposition processes to be used without a need to successively orient the entirety of component 80 during the heat treating process to produce a uniform thickness of first coating layer 362.

Additionally or alternatively, in some embodiments, at least first coating layer 362 is applied to interior portion 360 of hollow structure 320 in a slurry dipping process, such as, but not limited to, dipping an entirety of hollow structure 320 in a slurry that includes at least first coating material 366 and/or its precursors. In some such embodiments, outer wall 380 of hollow structure 320 is masked such that only interior portion 360 of hollow structure 320 is coated. Alternatively, outer wall 380 and interior portion 360 are both coated, and the coating on outer wall 380 is, for example, diffused into component material 78 when component 80 is cast.

Moreover, in some embodiments, hollow structure 320 is formed incrementally, such as by an additive manufacturing process or in sections that are later joined together. In some such embodiments, at least first coating layer 362 is applied to incremental portions of hollow structure 320 using a suitable application process, such as any of the application processes described above. For example, but not by way of limitation, a slurry injection process is used, and injection and removal of the relatively thick slurry for incremental portions of hollow structure 320 is more effective as compared to injection and removal of the relatively thick slurry to the entirety of internal passage 82 within component 80 after component 80 is formed, particularly, but not only, for internal passages 82 characterized by a high degree of nonlinearity, a complex cross-section, and/or a large length-to-diameter ratio.

Figure 7:
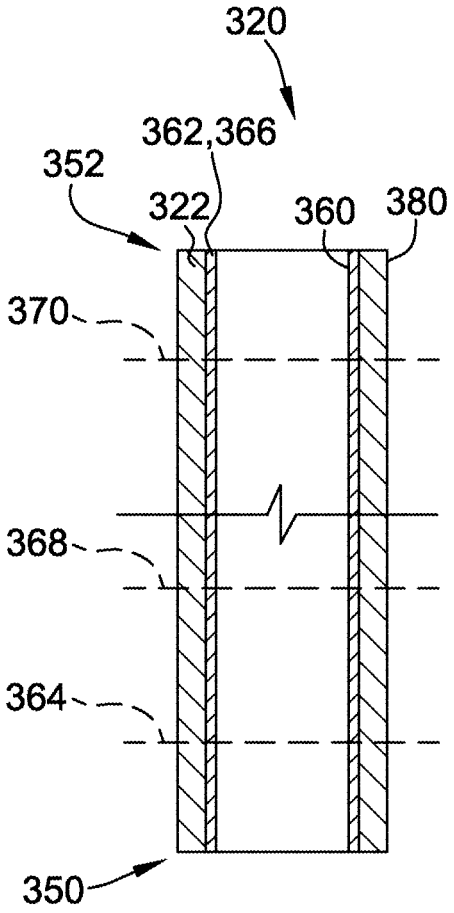
FIG. 7 is a schematic cross-section of a computer design model of a hollow structure for use with the mold assembly show in FIG. 2.

Additionally or alternatively, in some embodiments, at least first coating layer 362 is applied integrally to interior portion 360 of hollow structure 320 in an additive manufacturing process. For example, with reference also to FIG. 7, a computer design model of hollow structure 320 with at least first coating layer 362 applied thereto is sliced into a series of thin, parallel planes between a first end 350 and a second end 352, such that a distribution of first material 322 and first coating material 366 within each plane is defined. A computer numerically controlled (CNC) machine deposits successive layers of first material 322 and first coating material 366 from first end 350 to second end 352 in accordance with the model slices to form hollow structure 320. For example, the additive manufacturing process is suitably configured for alternating deposition of each of a plurality of metallic and/or metallic and ceramic materials, and the alternating deposition is suitably controlled according to the computer design model to produce the defined distribution of first material 322 and first coating material 366 in each layer. Three such representative layers are indicated as layers 364, 368, and 370. In some embodiments, the successive layers each including first material 322 and first coating material 366 are deposited using at least one of a direct metal laser melting (DMLM) process, a direct metal laser sintering (DMLS) process, a selective laser sintering (SLS) process, an electron beam melting (EBM) process, a selective laser melting process (SLM), and a robocasting extrusion-type additive process. Additionally or alternatively, the successive layers of first material 322 and first coating material 366 are deposited using any suitable process that enables hollow structure 320 to be formed as described herein.

In some embodiments, the formation of hollow structure 320 and first coating layer 362 by an additive manufacturing process enables hollow structure 320 to be formed with a uniform and repeatable distribution of first coating material 366 that would be difficult and/or relatively more costly to produce by other methods of applying first coating layer 362 to hollow structure 320. Correspondingly, the formation of hollow structure 320 by an additive manufacturing process enables component 80 to be formed with an integral distribution of first coating material 366 proximate interior wall 100 (shown, for example, in FIG. 6) that would be difficult and/or relatively more costly to apply to internal passage 82 in a separate process after initial formation of component 80 in mold 300.

In alternative embodiments, at least first coating layer 362 is applied to hollow structure 320 in any other suitable fashion that enables jacketed core 310 to function as described herein. Moreover, in certain embodiments in which first coating layer 362 is one of a plurality of coating layers of jacketed core 310, the additional coating layers, such as, but not limited to, second coating layer 372, are applied to hollow structure 320 in any of the processes described above for first coating layer 362, and/or in any other suitable fashion that enables jacketed core 310 to function as described herein.

After at least first coating layer 362 is applied to hollow structure 320, in some embodiments, inner core material 326 is injected as a slurry into hollow structure 320, and inner core material 326 is dried within hollow structure 320 to form jacketed core 310. Moreover, in certain embodiments, hollow structure 320 substantially structurally reinforces inner core 324, thus reducing potential problems that would be associated with production, handling, and use of an unreinforced inner core 324 to form component 80 in some embodiments. For example, in certain embodiments, inner core 324 is a relatively brittle ceramic material subject to a relatively high risk of fracture, cracking, and/or other damage. Thus, in some such embodiments, forming and transporting jacketed core 310 presents a much lower risk of damage to inner core 324, as compared to using an unjacketed inner core 324. Similarly, in some such embodiments, forming a suitable pattern around jacketed core 310 to be used for investment casting of mold 300, such as by injecting a wax pattern material into a pattern die around jacketed core 310, presents a much lower risk of damage to inner core 324, as compared to using an unjacketed inner core 324. Thus, in certain embodiments, use of jacketed core 310 presents a much lower risk of failure to produce an acceptable component 80 having internal passage 82 defined therein, as compared to the same steps if performed using an unjacketed inner core 324 rather than jacketed core 310. Thus, jacketed core 310 facilitates obtaining advantages associated with positioning inner core 324 with respect to mold 300 to define internal passage 82, while reducing or eliminating fragility problems associated with inner core 324.

For example, in certain embodiments, such as, but not limited to, embodiments in which component 80 is rotor blade 70, characteristic width 330 of inner core 324 is within a range from about 0.050 cm (0.020 inches) to about 1.016 cm (0.400 inches), and wall thickness 328 of hollow structure 320 is selected to be within a range from about 0.013 cm (0.005 inches) to about 0.254 cm (0.100 inches). More particularly, in some such embodiments, characteristic width 330 is within a range from about 0.102 cm (0.040 inches) to about 0.508 cm (0.200 inches), and wall thickness 328 is selected to be within a range from about 0.013 cm (0.005 inches) to about 0.038 cm (0.015 inches). For another example, in some embodiments, such as, but not limited to, embodiments in which component 80 is a stationary component, such as but not limited to stator vane 72, characteristic width 330 of inner core 324 greater than about 1.016 cm (0.400 inches), and/or wall thickness 328 is selected to be greater than about 0.254 cm (0.100 inches). In alternative embodiments, characteristic width 330 is any suitable value that enables the resulting internal passage 82 to perform its intended function, and wall thickness 328 is selected to be any suitable value that enables jacketed core 310 to function as described herein.

Moreover, in certain embodiments, prior to introduction of inner core material 326 within hollow structure 320 to form jacketed core 310, hollow structure 320 is pre-formed to correspond to a selected nonlinear shape of internal passage 82. For example, first material 322 is a metallic material that is relatively easily shaped prior to filling with inner core material 326, thus reducing or eliminating a need to separately form and/or machine inner core 324 into a nonlinear shape. Moreover, in some such embodiments, the structural reinforcement provided by hollow structure 320 enables subsequent formation and handling of inner core 324 in a non-linear shape that would be difficult to form and handle as an unjacketed inner core 324. Thus, jacketed core 310 facilitates formation of internal passage 82 having a curved and/or otherwise non-linear shape of increased complexity, and/or with a decreased time and cost. In certain embodiments, hollow structure 320 is pre-formed to correspond to the nonlinear shape of internal passage 82 that is complementary to a contour of component 80. For example, but not by way of limitation, component 80 is one of rotor blade 70 and stator vane 72, and hollow structure 320 is pre-formed in a shape complementary to at least one of an axial twist and a taper of component 80, as described above.

Figure 8:
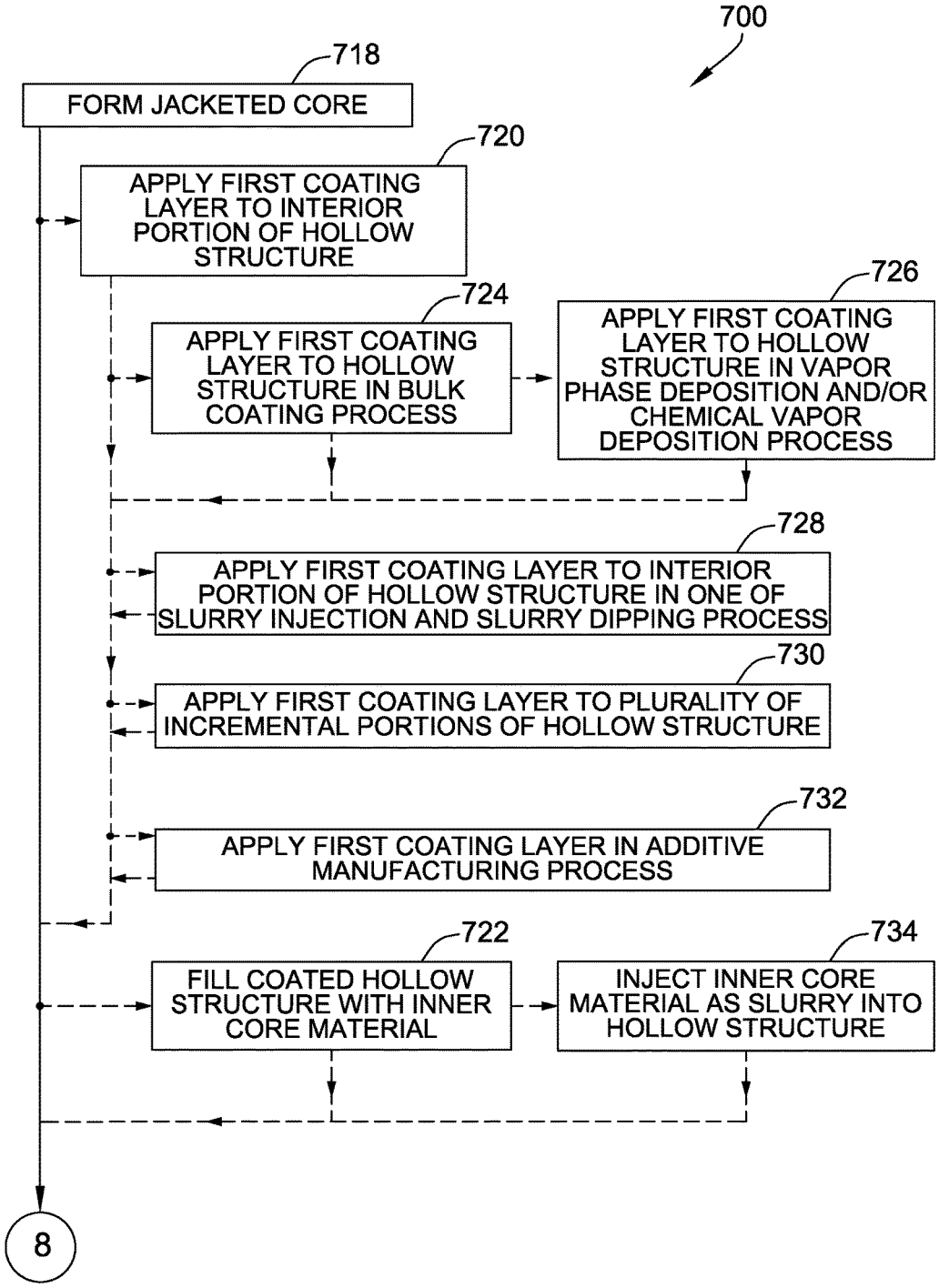
FIG. 8 is a flow diagram of an exemplary method of forming a component having an internal passage defined therein, such as a component for use with the rotary machine shown in FIG. 1.
Figure 9:
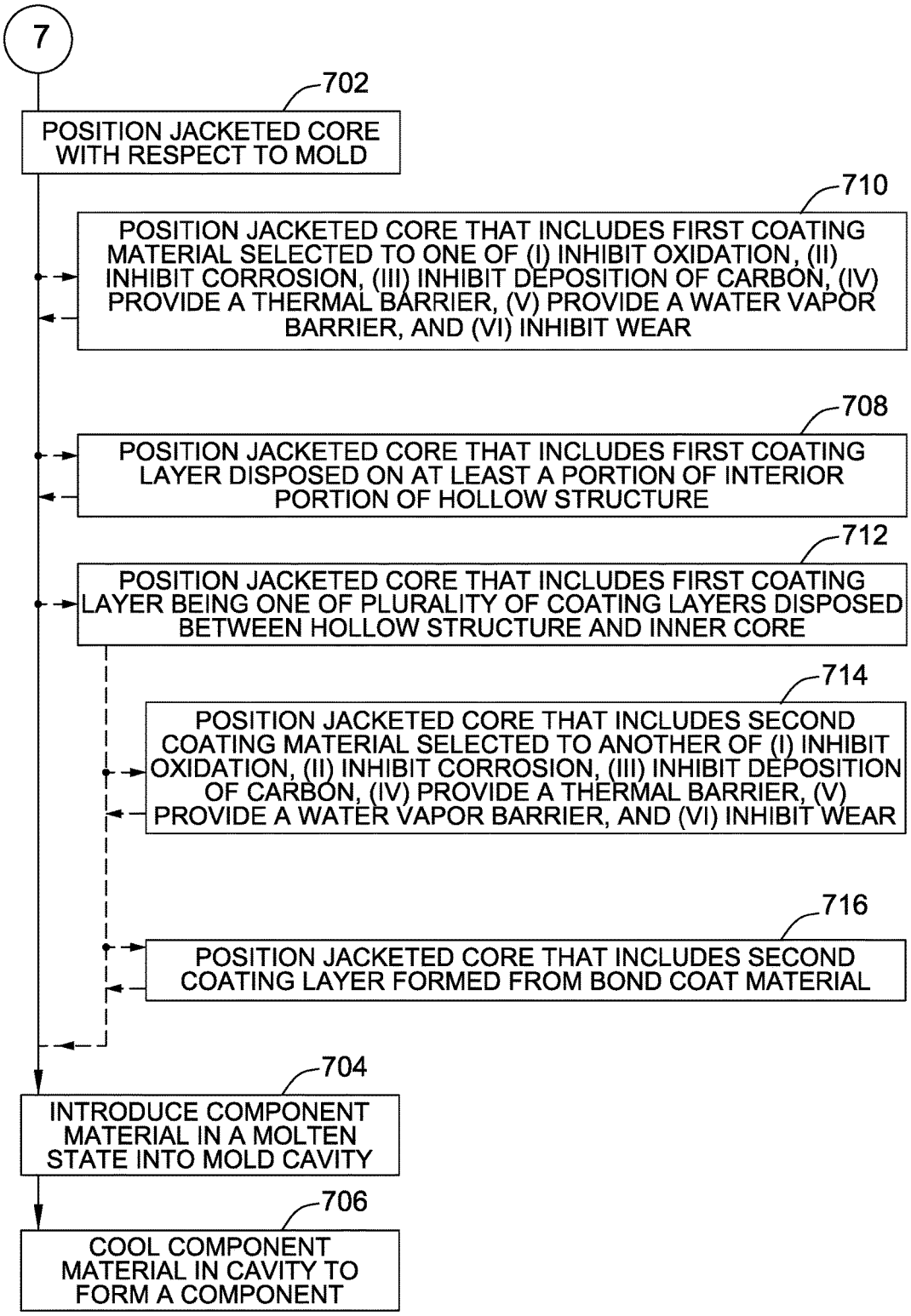
FIG. 9 is a continuation of the flow diagram from FIG. 9.

An exemplary method 700 of forming a component, such as component 80, having an internal passage defined therein, such as internal passage 82, is illustrated in a flow diagram in FIGS. 8 and 9. With reference also to FIGS. 1-7, exemplary method 700 includes positioning 702 a jacketed core, such as jacketed core 310, with respect to a mold, such as mold 300. The jacketed core includes a hollow structure, such as hollow structure 320, and an inner core, such as inner core 324, disposed within the hollow structure. The jacketed core also includes a first coating layer, such as first coating layer 362, disposed between the hollow structure and the inner core. The first coating layer is formed from a first coating material, such as first coating material 366. Method 700 also includes introducing 704 a component material, such as component material 78, in a molten state into a cavity of the mold, such as mold cavity 304, and cooling 706 the component material in the cavity to form the component. The inner core is positioned to define the internal passage within the component, and at least a portion of the first coating material lines at least a portion of the internal passage.

In some embodiments, the step of positioning 702 the jacketed core includes positioning 708 the jacketed core that includes the first coating layer disposed on at least a portion of an interior portion of the hollow structure, such as interior portion 360.

In certain embodiments, the step of positioning 702 the jacketed core includes positioning 710 the jacketed core that includes the first coating material selected from one of (i) an oxidation-inhibiting material, (ii) a corrosion-inhibiting material, (iii) a carbon-deposition-inhibiting material, (iv) a thermal barrier material, (v) a water vapor barrier material, and (vi) a wear-inhibiting material.

In some embodiments, the step of positioning 702 the jacketed core includes positioning 712 the jacketed core that includes the first coating layer being one of a plurality of coating layers disposed between the hollow structure and the inner core. In some such embodiments, the step of positioning 712 the jacketed core includes positioning 714 the jacketed core that includes the first coating material selected from one of (i) an oxidation-inhibiting material, (ii) a corrosion-inhibiting material, (iii) a carbon-deposition-inhibiting material, (iv) a thermal barrier material, (v) a water vapor barrier material, and (vi) a wear-inhibiting material, and a second of the plurality of coating layers, such as second coating layer 372, is formed from a second coating material, such as second coating material 376, selected from another of (i) an oxidation-inhibiting material, (ii) a corrosion-inhibiting material, (iii) a carbon-deposition-inhibiting material, (iv) a thermal barrier material, (v) a water vapor barrier material, and (vi) a wear-inhibiting material. Alternatively, the step of positioning 712 the jacketed core includes positioning 716 the jacketed core that includes the second coating layer formed from the second coating material that includes a bond coat material.

In certain embodiments, method 700 also includes forming 718 the jacketed core. In some such embodiments, the inner core is formed from an inner core material, such as inner core material 326, and the step of forming 718 the jacketed core includes applying 720 the first coating layer to an interior portion of the hollow structure, such as interior portion 360, and filling 722 the coated hollow structure with the inner core material.

In some embodiments, the step of applying 720 the first coating layer includes applying 724 the first coating layer to the hollow structure in a bulk coating process. In some such embodiments, the step of applying 724 the first coating layer includes applying 726 the first coating layer to the hollow structure in at least one of a vapor phase deposition process and a chemical vapor deposition process.

In certain embodiments, the step of applying 720 the first coating layer includes applying 728 the first coating layer to the interior portion of the hollow structure in one of a slurry injection process and a slurry dipping process.

In some embodiments, the hollow structure is formed incrementally, and the step of applying 728 the first coating layer includes applying 730 the first coating layer to a plurality of incremental portions of the hollow structure.

In certain embodiments, the step of applying 720 the first coating layer includes applying 732 the first coating layer to the interior portion of the hollow structure in an additive manufacturing process.

In some embodiments, the step of filling 722 the coated hollow structure with the inner core material includes injecting 734 the inner core material as a slurry into the hollow structure.

The exemplary components and methods described herein overcome at least some of the disadvantages associated with known assemblies and methods for forming a component having a coated internal passage defined therein. The embodiments described herein provide a jacketed core positioned with respect to a mold. The jacketed core includes (i) a hollow structure, (ii) an inner core disposed within the hollow structure, and (iii) a first coating layer disposed between the hollow structure and the inner core. The first coating layer includes a first coating material, and at least a portion of the first coating material lines at least a portion of the internal passage after a molten component material is introduced into the mold cavity and cooled to form the component.

The above-described jacketed core provides a cost-effective method for forming a component having a coated internal passage defined therein, especially but not limited to internal passages characterized by a high degree of nonlinearity, a complex cross-section, and/or a large length-to-diameter ratio. Specifically, the jacketed core includes (i) a hollow structure, (ii) an inner core disposed within the hollow structure, and (iii) a first coating layer disposed between the hollow structure and the inner core. The inner core extends within the mold cavity to define a position of the internal passage within the component to be formed in the mold. After a molten component material is introduced into the mold cavity to form the component, at least a portion of the first coating material lines at least a portion of the internal passage. Thus, the first coating layer formed as part of the jacketed core effectively applies the first coating material to the internal passage when the component is cast.

Also specifically, in certain embodiments, the first coating layer formed as part of the jacketed core enables the coating to be applied in a bulk deposition process without a need to position the entirety of the component in a deposition chamber, mask an entire outer surface of the component, and/or needlessly coat a large exterior surface area of the component, thereby reducing a time and cost required to apply the coating as compared to applying the coating to the internal passage within the component after the component is formed. Alternatively, in some embodiments, the first coating layer formed as part of the jacketed core enables the coating to be applied in a slurry deposition process without a need to successively orient the entirety of the component during the heat treating process to produce a uniform coating thickness.

An exemplary technical effect of the methods, systems, and apparatus described herein includes at least one of: (a) reducing or eliminating fragility problems associated with forming, handling, transport, and/or storage of the core used in forming a component having an internal passage defined therein; (b) enabling the use of longer, heavier, thinner, and/or more complex cores as compared to conventional cores for forming internal passages for components; and (c) enabling coating of internal passages, especially but not limited to internal passages characterized by a high degree of nonlinearity, a complex cross-section, and/or a large length-to-diameter ratio, with increased uniformity and/or reduced cost.

Exemplary embodiments of jacketed cores are described above in detail. The jacketed cores, and methods and systems using such jacketed cores, are not limited to the specific embodiments described herein, but rather, components of systems and/or steps of the methods may be utilized independently and separately from other components and/or steps described herein. For example, the exemplary embodiments can be implemented and utilized in connection with many other applications that are currently configured to use cores within mold assemblies.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of forming a component having an internal passage defined therein, said method comprising:

applying at least a first coating layer to an interior portion of a preformed hollow structure, wherein the hollow structure is formed from a first material that is metallic;

after said applying the at least first coating layer, disposing an inner core within the hollow structure to form a jacketed core;

positioning the jacketed core with respect to a mold;

introducing a component material in a molten state into a cavity of the mold, such that a portion of the jacketed core is submerged, and such that the component material in the molten state contacts the first material along substantially an entire outer perimeter of the submerged portion of the jacketed core; and cooling the component material in the cavity to form the component, wherein the inner core is positioned to define the internal passage within the component, and at least a portion of the first coating material lines at least a portion of the internal passage.

2. The method of claim 1, wherein positioning the jacketed core comprises positioning the jacketed core wherein the at least first coating layer includes a first coating material selected from one of (i) an oxidation-inhibiting material, (ii) a corrosion-inhibiting material, (iii) a carbon-deposition-inhibiting material, (iv) a thermal barrier material, (v) a water vapor barrier material, and (vi) a wear-inhibiting material.

3. The method of claim 1, wherein positioning the jacketed core comprises positioning the jacketed core wherein the at least first coating layer includes a plurality of coating layers disposed between the hollow structure and the inner core.

4. The method of claim 3, wherein positioning the jacketed core further comprises positioning the jacketed core wherein the at least first coating layer includes a first coating material selected from one of (i) an oxidation-inhibiting material, (ii) a corrosion-inhibiting material, (iii) a carbon-deposition-inhibiting material, (iv) a thermal barrier material, (v) a water vapor barrier material, and (vi) a wear-inhibiting material, and a second of the plurality of coating layers is formed from a second coating material selected from another of (i) an oxidation inhibiting material, (ii) a corrosion-inhibiting material, (iii) a carbon-deposition-inhibiting material, (iv) a thermal barrier material, (v) a water vapor barrier material, and (vi) a wear-inhibiting material.

5. The method of claim 3, wherein positioning the jacketed core further comprises positioning the jacketed core that includes a second of the plurality of coating layers formed from a bond coat material.

6. The method of claim 1, wherein applying the at least first coating layer comprises applying the at least first coating layer to the interior portion of the hollow structure in a bulk coating process.

7. The method of claim 6, wherein applying the at least first coating layer comprises applying the at least first coating layer to the hollow structure in at least one of a vapor phase deposition process and a chemical vapor deposition process.

8. The method of claim 1, wherein applying the at least first coating layer comprises applying the at least first coating layer to the interior portion of the hollow structure in at least one of a slurry injection process and a slurry dipping process.

9. The method of claim 1, wherein the hollow structure is formed incrementally, and applying the at least first coating layer comprises applying the at least first coating layer to a plurality of incremental portions of the hollow structure.

10. The method of claim 1, wherein applying the at least first coating layer comprises applying the at least first coating layer in an additive manufacturing process.

11. The method of claim 1, wherein disposing the inner core comprises injecting an inner core material as a slurry into the hollow structure.

* * * * *